United States Patent [19]

Nicol

[11] 3,970,976

[45] July 20, 1976

[54] CIRCUIT BREAKER WITH CENTER TRIP POSITION

[75] Inventor: Ronald Nicol, Trenton, N.J.

[73] Assignee: Heinemann Electric Company, Trenton, N.J.

[22] Filed: Apr. 4, 1975

[21] Appl. No.: 565,271

[52] U.S. Cl. ..... 335/21; 335/27; 335/170

[51] Int. Cl.[2] ..... H01H 73/00; H01H 75/00

[58] Field of Search ..... 335/21, 22, 38, 35, 335/174, 170, 15, 26, 27, 28

[56] References Cited

UNITED STATES PATENTS

| | | | |
|---|---|---|---|
| 3,046,371 | 7/1962 | Jencks | 335/38 |
| 3,492,614 | 1/1970 | Angelo et al. | 335/21 |
| 3,731,239 | 5/1973 | Ellenberger | 335/22 |
| 3,849,748 | 11/1974 | Orriss | 335/21 |

*Primary Examiner*—Harold Broome
*Attorney, Agent, or Firm*—Joseph G. Denny, III; Peter J. Patane

[57] ABSTRACT

A circuit breaker comprising a case and a stationary contact mounted within said case. A movable contact is movable into and out of engagement with the stationary contact. An operator is pivotally mounted within said case and a collapsible linkage interconnects the said operator and the movable contact. An electromagnetic sensing device collapses the collapsible linkage upon predetermined electrical overloads to move the contacts from the contacts "closed" position to the contacts "open" position. The collapsible linkage carries a restraining means for restraining the operator in a position intermediate the "open" and "closed" positions of the contacts.

8 Claims, 11 Drawing Figures

FIG. 1
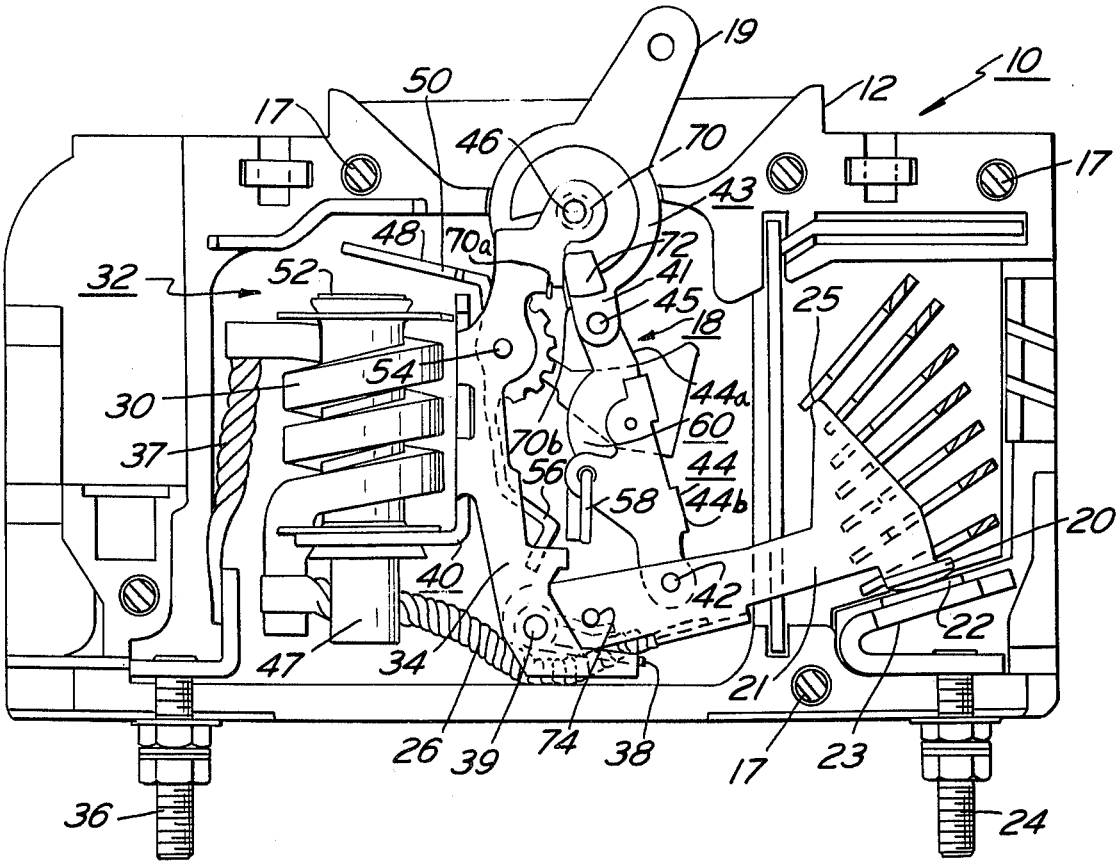
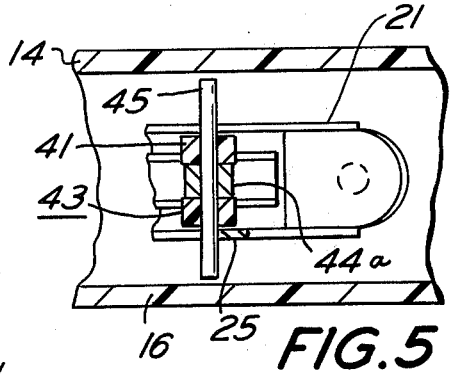
FIG. 5
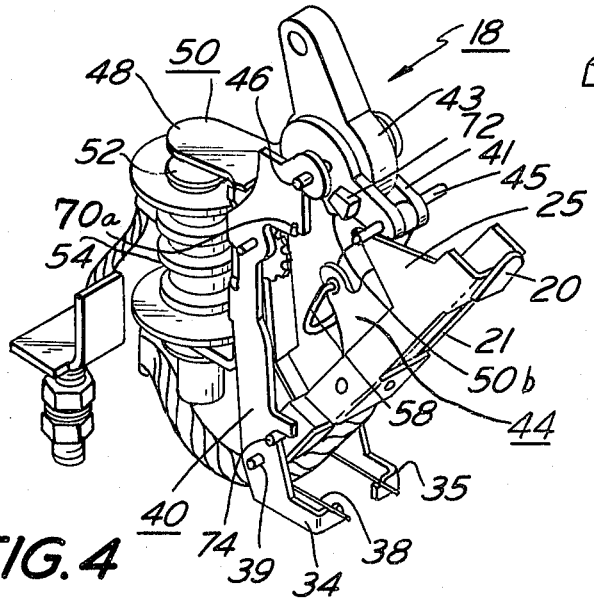
FIG. 4

FIG. 3
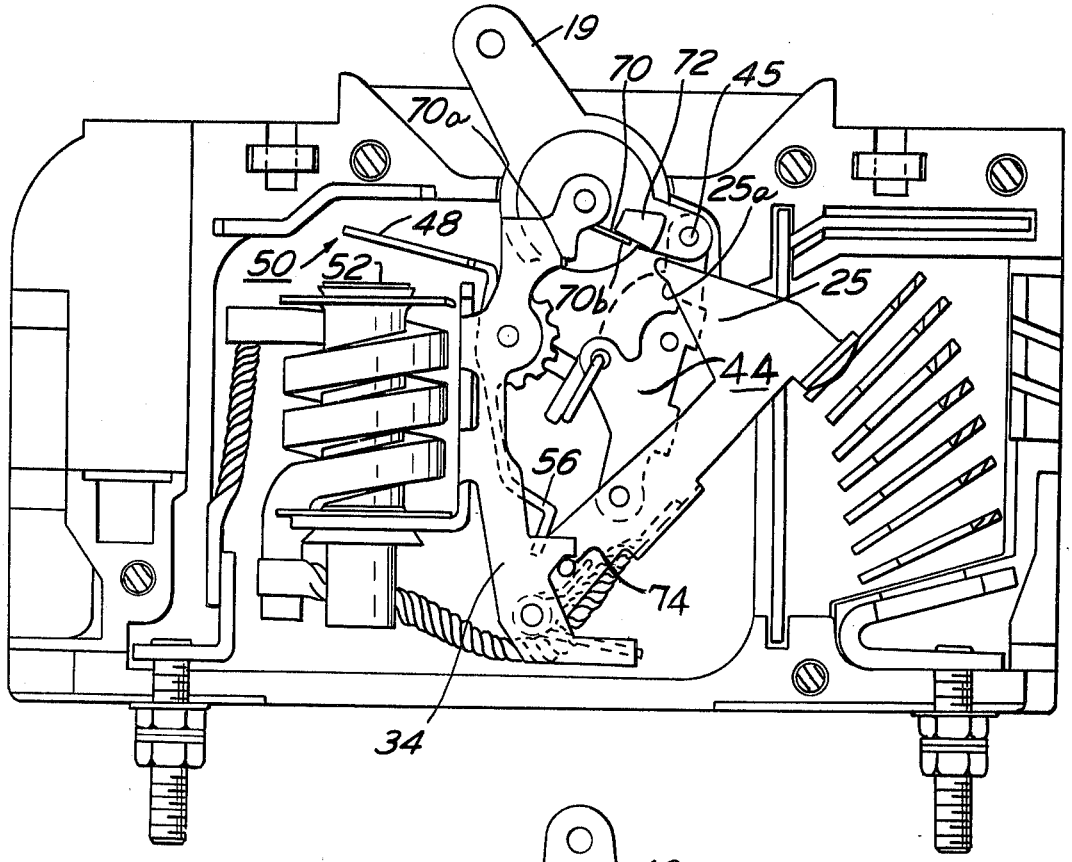
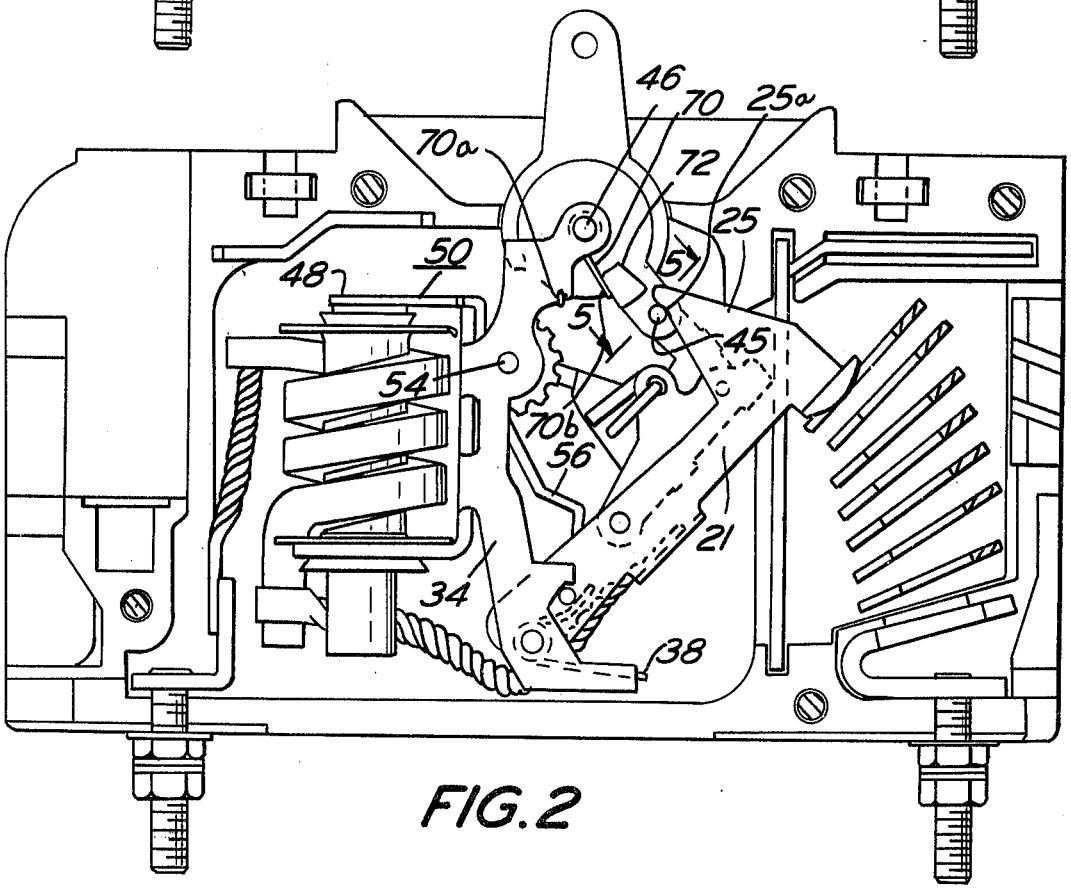
FIG. 2

FIG. 6
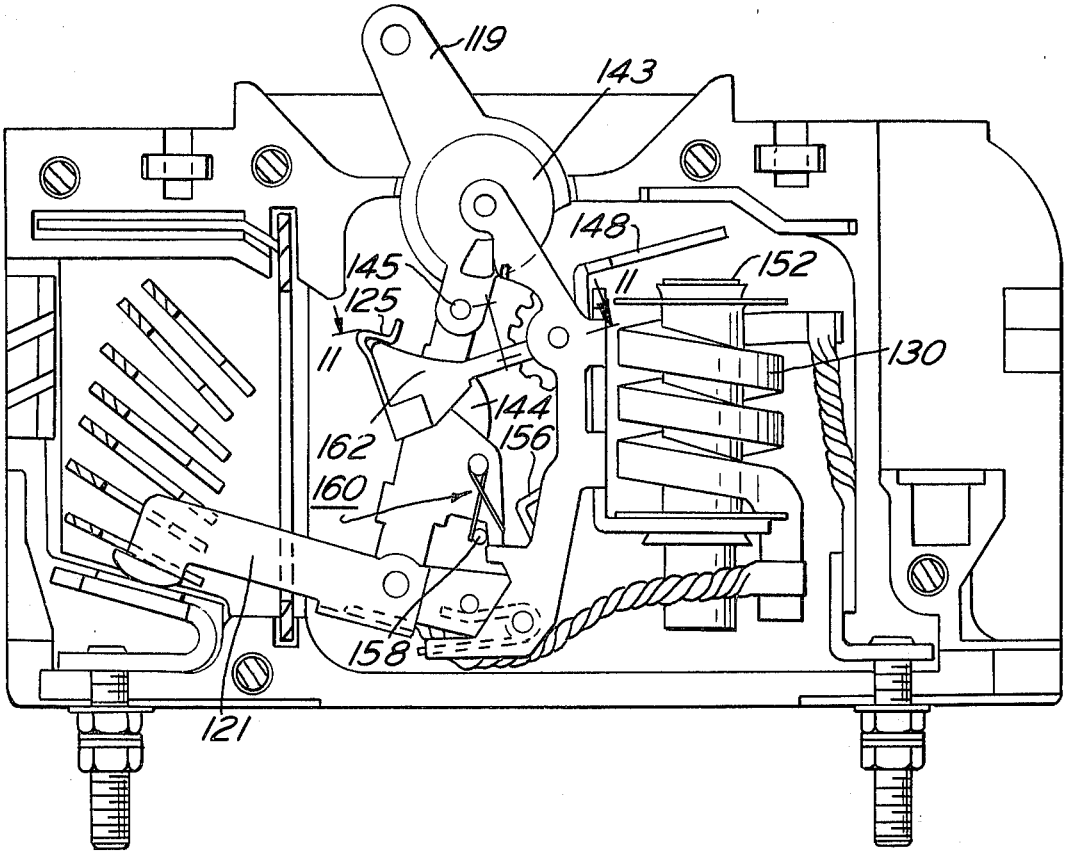
FIG. 10
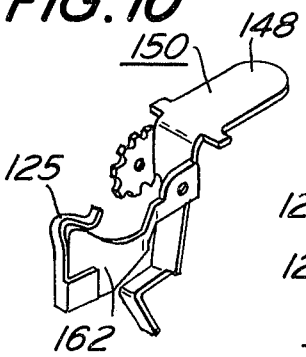
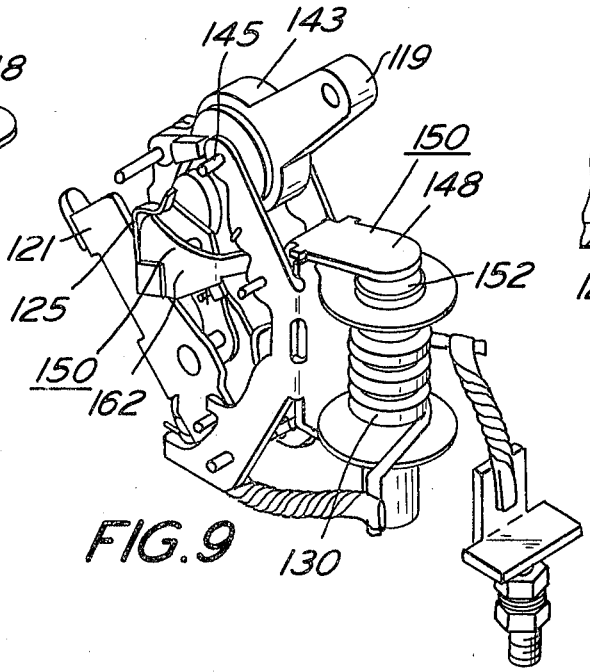
FIG. 9
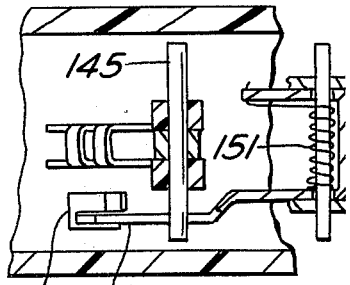
FIG. 11

FIG. 8
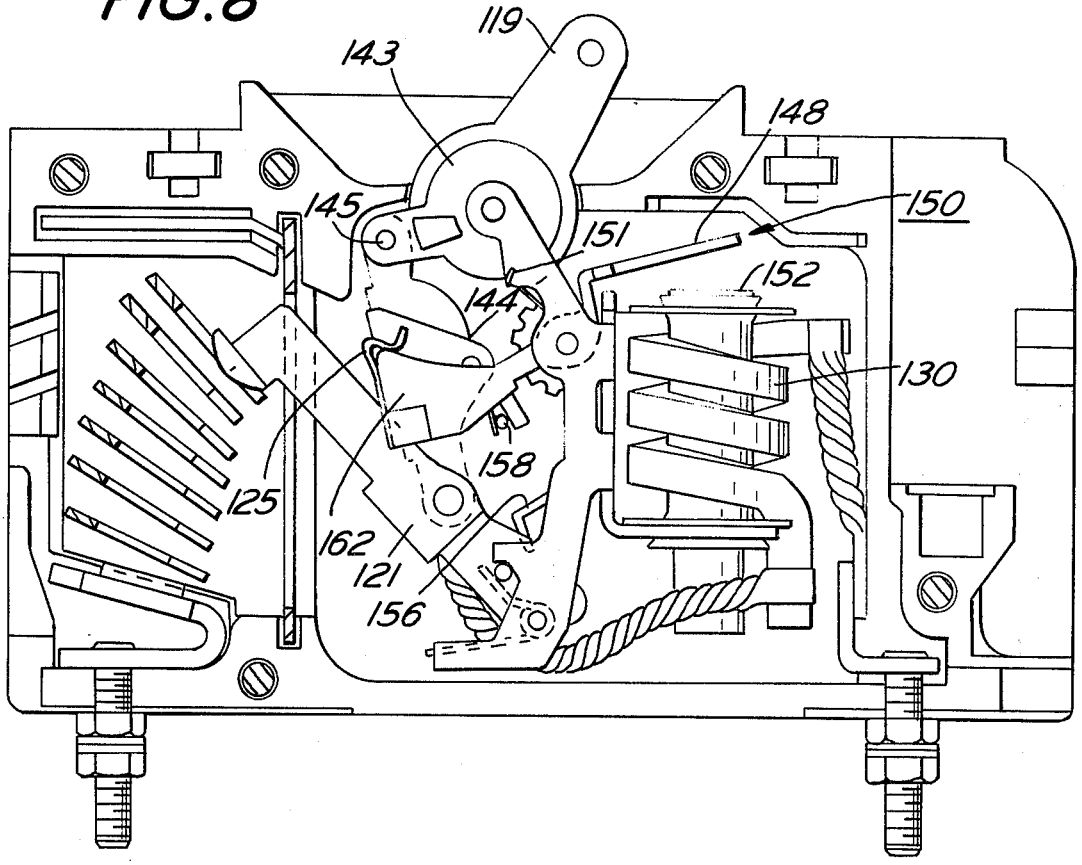
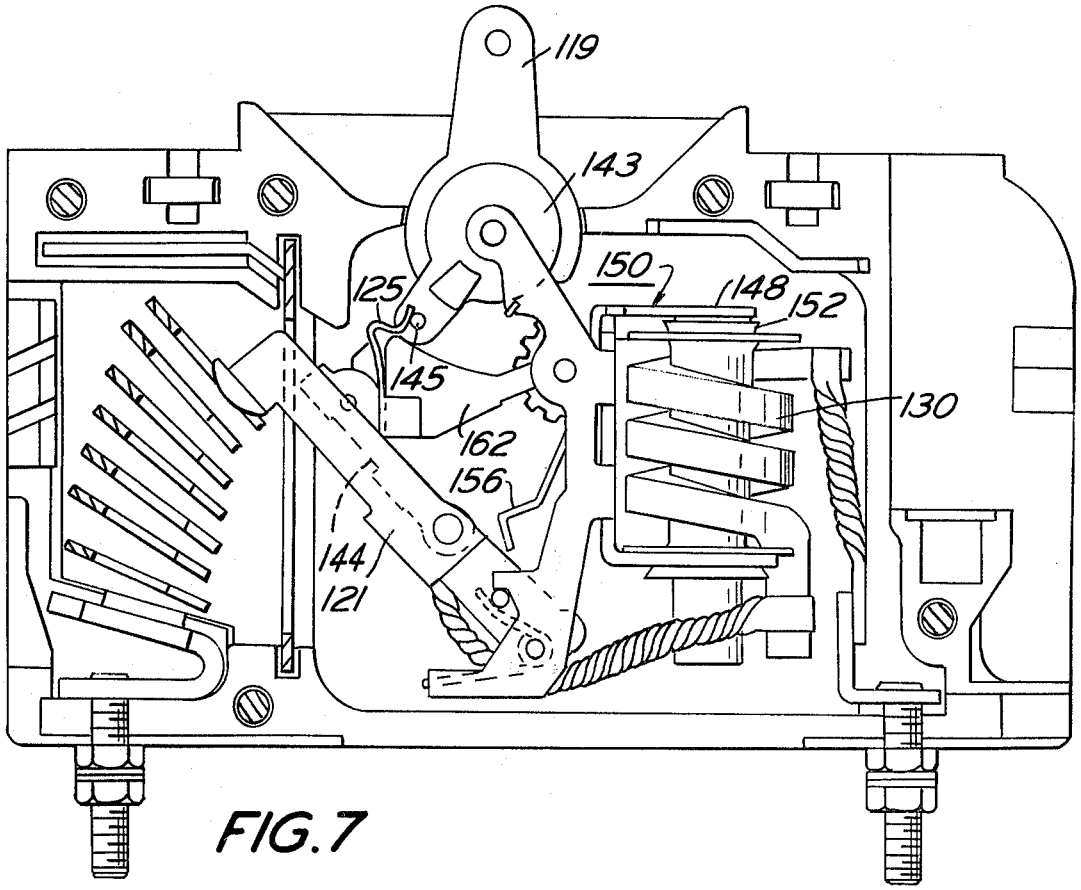
FIG. 7

CIRCUIT BREAKER WITH CENTER TRIP POSITION

BACKGROUND OF THE INVENTION

This invention relates generally to electric circuit breakers of the electromagnetic type and more particularly to circuit breakers with arrangements for indicating the electrically tripped "open" condition of the circuit breaker.

Ciruit breakers with arrangements for indicating the electrically tripped "open" condition of the circuit breaker contacts are shown in U.S. Pat. Nos. 3,742,402 and 3,742,403, and pending patent application Ser. No. 384,702, all assigned to the Heinemann Electric Company. Further, a circuit breaker of the electromagnetic type is shown, for example, in Camp U.S. Pat. No. 3,329,913, also assigned to the Heinemann Electric Company.

Such electromagnetic circuit breakers typically comprise a movable contact, mounted on a movable arm, and a stationary contact. An operating handle is coupled to the movable contact by a linkage mechanism. The linkage mechanism includes the movable arm on which contact is mounted and a collapsible toggle assembly. The movable and stationary contacts are operated between the contacts "open" and the contacts "closed" positions by pivoting the operating handle. The circuit breaker further comprises an electromagnetic device which, in response to predetermined electrical conditions, collapses the toggle assembly, to thereby electrically trip "open" the contacts.

BRIEF SUMMARY OF THE INVENTION

It is an object of this invention to provide a restraining means for the operating handle which is part of, and movable with, the linkage mechanism connecting the operating handle and the movable contact.

The foregoing and other objects of the invention, the principles of the invention and the best modes in which I have contemplated applying such principles will more fully appear from the following description and accompanying drawings in illustration thereof.

BRIEF DESCRIPTION OF THE VIEWS

In the drawings:

FIG. 1 is a side elevation view, with one half-case removed, of a circuit breaker incorporating the present invention, the circuit breaker being shown in the contacts closed position;

FIG. 2 is a side elevation view, similar to FIG. 1, but showing the electrically tripped open position of the contacts with the handle link restrained in its central position and the contacts open position;

FIG. 3 is a side elevation view, similar to FIG. 1, but showing the contacts open position and the handle in the contacts open position;

FIG. 4 is a top, partial perspective view of the internal mechanism of the circuit breaker shown in FIGS. 1 to 3;

FIG. 5 is a partial sectional view taken along the lines 5—5 in FIG. 2;

FIG. 6 is a side elevation view of a circuit breaker incorporating a modified embodiment of the present invention, one half-case being removed and the circuit breaker being shown in the contacts closed position;

FIG. 7 is a side elevation view of the embodiment illustrated in FIG. 6, but showing the electrically tripped open position of the contacts with the handle link restrained in its central position and the contacts open;

FIG. 8 is a side elevation view of the embodiment illustrated in FIG. 6, but showing the contacts open position and the handle in the contacts open position;

FIG. 9 is a top partial perspective view of the internal mechanism of the embodiment illustrated in FIG. 6;

FIG. 10 is a perspective view of the armature of the embodiment illustrated in FIG. 6; and FIG. 11 is a partial sectional view taken along the lines 11—11 in FIG. 6.

DESCRIPTION OF THE PREFERRED EMBODIMENTS

Referring to the drawings and the embodiment shown in FIGS. 1 to 5 thereof, the circuit breaker 10 comprises an insulating case 12, preferably molded from a plastic material, divided into two juxtaposed, approximately half-cases 14 and 16, FIG. 5 secured together by suitable rivets 17. The circuit breaker 10 includes a stationary contact 22 (carried by a supporting conductor 23 forming part of a terminal 24) and a movable contact 20. The circuit breaker further comprises a mechanism 18 including a movable arm 21 carrying the movable contact 20. The mechanism 18 also includes an operator or handle 19 which extends out of the case 12, as shown, to manually open and close the contacts 20 and 22.

The movable arm 21 is connected by a flexible conductor 26 to one end of a coil 30 forming part of an electromagnetic device 32 which is also enclosed by the case 12 and which also comprises part of the mechanism 18 to trip open the contacts on predetermined overloads. The electrical circuit of the circuit breaker is completed by connecting the other end of the coil 30 to a terminal 36 by a conductor 37. As shown, the terminals 24 and 36 are carried by the case 12 and extend outwardly therefrom.

The movable arm carries an extension 25, extending upwardly as shown in FIGS. 1 and 4, rearwardly of the forwardmost or rightmost part of the movable arm 21 for the purpose of limiting rotation of the handle 19 from the contacts closed position of FIG. 1 to the contacts open position of FIG. 3, as hereinafter further described, upon electrical tripping of the circuit breaker.

Further, the movable arm 21 is biased by a spring 38 toward the open position of the contacts 20 and 22 and the movable arm 21 is mounted on a pin 39 about which it pivots, the pin 39 having end portions carried by two spaced plates 34 and 35 (FIG. 4) forming part of an L-shaped frame 40, only the plate 34 being shown in FIG. 1. The movable arm 21 is also connected by a pin 42 to the lower link 44*b* of a toggle or latching mechanism 44, the latter also comprising part of the mechanism 18.

The handle 19 is part of a handle link 43 which also includes an arm 41, the toggle mechanism 44 being connected to the arm 41 by a pin 45. As shown, in FIG. 4, the arm 41 is bifurcated to centrally receive the upper link 44*a* of the toggle mechanism 44. The handle link 43 is mounted on the plates 34 and 35 and pivots about a pin 46 having end portions carried by the spaced plates 34 and 35.

The frame plates 34 and 35 and the integral L-shaped magnetic frame 40 form part of the electromagnetic device 32 and to which is secured a time delay tube 47 housing a spring biased magnetizable core (not illustrated) movable against the retarding action of a suitable fluid to provide a time delay before tripping of the mechanism at certain overloads. As illustrated, the frame 40 also carries the coil 30.

The construction and operation of this type of mechanism 18 and electromagnetic device 32 is generally set forth in Pat. No. 2,360,922 and 3,422,235 among others, but for clarity's sake may be briefly described as follows--when the handle 19 is rotated clockwise, as viewed in FIGS. 3 and 4, the toggle mechanism 44 and the movable arm 21 all move down, against the bias of the spring 38, and move the contact 20 into engagement with the contact 22, the contacts assuming the closed position illustrated in FIG. 1.

Upon the occurence of predetermined overload conditions, assuming the circuit breaker to be in the contacts closed position of FIG. 1, an armature 50 (which is also part of the electromagnetic device 32) has a leg 48 which is attracted toward a pole piece 52 either after a time delay period or virtually instantaneously, depending on the overload current. At such time the leg 48 moves toward the pole piece 52, causing the armature 50 to pivot to the position of FIG. 2 about a pin 54 whose end portions are also carried by the spaced frame plates 34 and 35 at which time the oppositely extending trip member 56 (which is an integral part of the armature 50) pivots counterclockwise (as viewed in FIG. 1) to engage and trip the arm 58 forming part of a latch 60 which, when the toggle mechanism 44 has been moved to the contacts closed position, is juxtaposed with the trip member 56, whereupon the toggle mechanism 44 collapses under the pressure of the opening spring 38.

Upon the collapse of the toggle mechanism 44, the movable arm 21 rotates counterclockwise, as viewed in FIGS. 1 and 2, from the position of FIG. 1 to the position of FIG. 2. The handle link 43 also rotates counterclockwise at such time under pressure of a handle reset spring 70 which is carried about the pin 46 and between the handle link 43 and the frame plate 34, the spring 70 being partially shown in FIGS. 1 and 2 and having one end **70*a* hooked around the frame plate 34 and its other end 70*b* biased against a stop projection 72 formed on the arm 41. The pin 45 extends beyond the sides of the bifurcated arm 41, as shown in FIG. 4.**

The sequence is such that the movable arm 21 rotates counterclockwise to the position of FIG. 3 at which time the contacts 20 and 22 have separated the maximum amount and the movable arm 21 has come to rest with a pin 74 which it carries abutting the frame plates 34 and 35, as shown in FIG. 2, and thereafter the pivoting handle 43 reaches the position shown in FIG. 2. As a result, the rotation of the handle link 43 to its full "off" or full contacts open position (shown in FIG. 3) is aborted by engagement of an end portion of the pin 45 with the extension 25, the handle link 43 coming to rest in the position shown in FIG. 2 in which the handle 19 is an approximately vertical position about midway between its contacts "on" position of FIG. 1 and its contacts "off" position of FIG. 3. As shown in FIG. 2, the pin 45 is received in and rests in a concave depression **25*a* formed in the extension 25. Thus, a visual indication is provided by the midposition of the handle 19** indicating that the circuit breaker has been electrically tripped.

After electrical tripping of the circuit breaker, when it is desired to move the handle 19 to the full "off" position, that is, the position shown in FIG. 3, a manual (or other type) force is applied to the handle 19 tending to rotate counterclockwise, as viewed in FIG. 3. At such time the pin 45 pushes against the extension 25 rotating the movable arm 21 clockwise. As the pin 45 rotates counterclockwise, the arm 21 rotates clockwise, and the pin 45 tends to move up and the extension 25 moves down, the extension 25 sliding along the pin 45 until the pin 45 and the extension 25 separate from each other, i.e., the pin 45 rides over the top of the extension 25. The handle link 43 is then free to rotate and the handle 19 then moves counterclockwise to the full "off" position shown in FIG. 3. Preferably, the pin 45 and the extension 25 are lubricated to facilitate relative movement.

Likewise, if the contacts 20 and 22 are closed, the position of FIG. 1, the handle 19 may be manually moved from the position of FIG. 1 to that of FIG. 3 without any engagement taking place between the pin 45 and the extension 25, because the proportions of the various parts are such that the pin 45 traverses a path above and clear of the extension 25 as the extension moves to the position of FIG. 3.

When desired, the contacts 20 and 22 may be reclosed by rotating the handle 19 clockwise from the position of FIG. 3 to that of FIG. 1. In so doing, the movable arm 21 moves down (clockwise) sufficiently in advance of the pin 45 so that the pin 45 traverses a path always above and clear of the extension 25 in the movement to the contacts closed position.

Referring to FIGS. 6 to 11 another embodiment of this invention is illustrated. In this embodiment, a flexible spring extension 125 is added to the usual balance (or third) arm 162 of the armature 150.

When the coil 130 is sufficiently energized, the leg 148 of the armature 150 is attracted to the pole piece 152 and rotates to the position shown in FIG. 7. During such movement of the armature 150, its trip member 156 engages and unlatches the arm 158 of the latch 160, whereupon the movable arm 121 moves to the position shown in FIG. 7.

However, the extension 125 lies in the path of movement of the pin 145 connecting the handle link 143 to the toggle mechanism 144, restraining the handle link 143 in its approximate midtrip position in which the handle 119 is approximately vertically disposed about half-way between its contacts "on" and contacts "off" positions.

After electrical tripping of the circuit breaker, if it is desired to move the handle 119 to the contacts "off" position, the handle is rotated clockwise, as viewed in FIG. 7. Pressure on the handle 119 to so rotate the handle 119 will cause the pin 145 to press forcefully against the spring extension 125. The extension 125 is flexible enough to bend at such time and permit the pin 145 to pass beyond the extension 125 after which the extension 125 springs back to its original position and shape, as the armature 150 returns to its original position under pressure of the armature reset spring 151.

The spring extension 125 is preferably formed as a separate piece and soldered or otherwise suitably secured to the arm 162. It is to be understood, however, that the arm 162 could be formed with a suitable, integral extension to perform the function of the spring extension 125.

Thus, it is seen that a circuit breaker has been provided having a mechanism which includes a movable arm with an extension or a mechanism which includes an armature having a spring extension for the purpose of restraining the handle in a position intermediate its contacts "on" and contacts "off" positions during movement of the handle from the contacts "on" to the contacts "off" positions following electrical tripping of the circuit breaker, but which may be manually moved from the contacts "on" to the contacts "off" positions and vice versa free of either the movable arm extension of the armature extension.

Having described this invention, what I claim is:

1. A circuit breaker comprising
a case,
a stationary contact mounted within said case,
a movable contact within said case and movable into and out of engagement with said stationary contact,
a collapsible and automatically resettable mechanism for manually opening and closing said contacts and for electrically tripping "open" said contacts on predetermined conditions comprising
an operator pivotally mounted within said case,
a collapsible and automatically relatchable linkage for interconnecting said operator and said movable contact, and
means for collapsing said collapsible and automatically relatchable linkage upon predetermined electrical overloads to move said contacts from the contacts "closed" position to the contacts "open" position,
restraining means movable as part of said mechanism upon electrical tripping "open" of said contacts to a position for restraining said operator in a position intermediate the "open" and "closed" positions of said operator to defeat said collapsible and automatically relatchable linkage, whereby said operator is maintained in a position intermediate the "open" and "closed" positions of said contacts upon electrical tripping of said contacts and said collapsible and automatically relatchable linkage is prevented from automatically relatching until the restraint is removed.

2. A circuit breaker comprising
a case,
a stationary contact mounted within said case,
a movable contact within said case and movable into and out of engagement with said stationary contact,
a mechanism for manually opening and closing said contacts and for electrically tripping "open" said contacts on predetermined conditions comprising
an operator pivotally mounted with said case,
a collapsible linkage for interconnecting said operator and said movable contact,
means for collapsing said collapsible linkage upon predetermined electrical overloads to move said contacts from the contacts "closed" position to the contacts "open" position, and
restraining means movable as part of said mechanism upon electrical tripping "open" of said contacts to a position for restraining said operator in a position intermediate the "open" and "closed" positions of said operator,
a movable arm carrying said movable contact,
said movable arm having a portion engaged by said operator to restrain movement of said operator in a position intermediate the contacts "on" and "off" positions upon electrical tripping of said contacts.

3. The structure of claim 2 wherein
said movable arm includes a projection which extends toward said operator,
said operator includes a portion engaged by said projection to restrain said operator in a position intermediate the contacts "on" and "off" positions subseqent to electrical tripping.

4. The structure of claim 3 which further includes
a pin which pivotally connects said operator to said collapsible linkage,
said projection on said movable arm is cam-like to receive an end portion of said pin.

5. A circuit breaker comprising
a case,
a stationary contact mounted within said case,
a movable contact within said case and movable into and out of engagement with said stationary contact,
a mechanism for manually opening and closing said contacts and for electrically tripping "open" said contacts on predetermined conditions comprising
an operator pivotally mounted within said case,
a collapsible linkage for interconnecting said operator and said movable contact,
means for collapsing said collapsible linkage upon predetermined electrical overloads to move said contacts from the contacts "closed" position to the contacts "open" position, and
restraining means movable as part of said mechanism upon electrical tripping "open" of said contacts to a position for restraining said operator in a position intermediate the "open" and "closed" positions of said operator,
said means for collapsing said collapsible linkage including
an armature,
said armature having a portion engaged by said operator to restrain movement of said operator in a position intermediate the contacts "off" and the contacts "on" positions upon electrical tripping of said contacts.

6. The structure of claim 5 wherein
said armature includes a spring member which extends toward said operator,
said operator includes a portion engaged by said spring member to restrain said operator in a position intermediate the contacts "on" and "off" positions subsequent to electrical tripping.

7. The structure of claim 6 which further includes
a pin which pivotally connects said operator to said collapsible linkage,
said spring member is cam-like to receive an end portion of said pin.

8. A circuit breaker comprising
a case,
a stationary contact mounted within said case,
a movable contact within said case and movable into and out of engagement with said stationary contact, and
an automatically resettable mechanism for manually opening and closing said contacts and for electrically tripping "open" said contacts on predetermined conditions comprising
an operator pivotally mounted within said case, an automatically relatchable linkage for interconnecting said operator and said movable contact, and means for moving said linkage upon predetermined electrical overloads from the contacts "closed" position to the contacts "open" position, and restraining means movable upon electrical tripping "open" of said contacts from a position out of restraining engagement with said operator to a position in restraining engagement with said operator to defeat said automatically relatchable linkage, whereby said operator is maintained in a position intermediate the "open" and "closed" positions of said contacts upon electrical tripping of said contacts and said relatchable linkage is prevented from automatically relatching until said restraining means is manually moved out of said restraining engagement.

* * * * *